US010739691B2

(12) United States Patent
Kayamori et al.

(10) Patent No.: US 10,739,691 B2
(45) Date of Patent: Aug. 11, 2020

(54) ELECTROSTATIC IMAGE DEVELOPING TONER AND DEVELOPER

(71) Applicant: Konica Minolta, Inc., Tokyo (JP)

(72) Inventors: Takanari Kayamori, Kawasaki (JP); Masaharu Matsubara, Hachioji (JP); Naoya Tonegawa, Sagamihara (JP); Atsushi Iioka, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/590,712

(22) Filed: Oct. 2, 2019

(65) Prior Publication Data

US 2020/0150551 A1 May 14, 2020

(30) Foreign Application Priority Data

Nov. 14, 2018 (JP) ..... 2018-213588

(51) Int. Cl.

*G03G 9/08* (2006.01)
*G03G 9/16* (2006.01)
*G03G 9/087* (2006.01)
*G03G 9/097* (2006.01)

(52) U.S. Cl.

CPC ..... *G03G 9/16* (2013.01); *G03G 9/08755* (2013.01); *G03G 9/08795* (2013.01); *G03G 9/08797* (2013.01); *G03G 9/09775* (2013.01)

(58) Field of Classification Search

CPC ..... G03G 9/08755; G03G 9/09775
USPC ..... 430/108.21, 109.4
See application file for complete search history.

(56) References Cited

FOREIGN PATENT DOCUMENTS

JP 2016224367 A 12/2016

*Primary Examiner* — Mark A Chapman
(74) *Attorney, Agent, or Firm* — Lucas & Mercanti, LLP

(57) ABSTRACT

An electrostatic image developing toner includes toner base particles, wherein the toner base particles contain: an amorphous polyester resin; a crystalline resin; and o-acetoacetaniside, and the content of the o-acetoacetaniside in the toner base particles is 0.1 ppm by mass or more and 200 ppm by mass or less.

8 Claims, No Drawings

ELECTROSTATIC IMAGE DEVELOPING TONER AND DEVELOPER

The entire disclosure of Japanese patent Application No. 2018-213588, filed on Nov. 14, 2018, is incorporated herein by reference in its entirety.

BACKGROUND

Technological Field

The present invention relates to an electrostatic image developing toner containing a crystalline resin and an amorphous resin, and a developer containing the electrostatic image developing toner.

Description of the Related Art

In an electrophotographic image forming apparatus, an image is formed on a transfer medium such as paper using an electrostatic image developing toner (hereinafter also simply referred to as toner) and then fixed. As a fixing method, a heat roller fixing method in which a transfer medium after image formation passes between a heating roller and a pressure roller is widely used.

In recent years, in an electrophotographic image forming apparatus, there is an increasing demand for energy saving from a viewpoint of reducing an environmental load or the like. For this reason, in order to fix a toner with a small amount of energy, development of a toner capable of lowering a fixing temperature has been progressed. As a typical method for lowering the toner fixing temperature, a method using a crystalline resin for toner base particles is known. The crystalline resin melts at a melting point to plasticize an amorphous resin. For this reason, inclusion of the crystalline resin can lower the toner fixing temperature. However, if there is a portion where the crystalline resin and the amorphous resin are compatible before a fixing step, that is, while a toner exists as toner particles, heat-resistant storage stability of the toner may be reduced.

In order to suppress reduction in heat-resistant storage stability of the toner due to compatibility between the crystalline resin and the amorphous resin, a technique for increasing crystallinity of the crystalline resin is used. For example, it is known to use a crystal nucleating agent as a technique for increasing crystallinity of a crystalline resin in a toner (see, for example, JP 2016-224367 A). JP 2016-224367 A describes that inclusion of a crystal nucleating agent having a specific structure together with a hybrid crystalline resin as toner base particle improves low-temperature fixability, high-temperature storage stability, and charging uniformity of a toner. As described above, introduction of the crystal nucleating agent into the toner base particles is effective from a viewpoint of promoting crystallization of a crystalline resin in a binder resin.

As described above, by introducing the crystal nucleating agent into the toner base particles, it is possible to manufacture toner base particles capable of suppressing reduction in heat-resistant storage stability and improving low-temperature fixability. However, a toner using toner base particles into which a crystal nucleating agent has been introduced tends to reduce dispersibility of a crystalline resin. For this reason, it is difficult to obtain high image density with a toner using a crystal nucleating agent.

SUMMARY

In order to solve the above-described problems, an embodiment of the present invention provides an electrostatic image developing toner capable of obtaining low-temperature fixability and high image density, and a developer.

To achieve the abovementioned object, according to an aspect of the present invention, an electrostatic image developing toner reflecting one aspect of the present invention comprises toner base particles, wherein the toner base particles contain: an amorphous polyester resin; a crystalline resin; and o-acetoacetaniside, and the content of the o-acetoacetaniside in the toner base particles is 0.1 ppm by mass or more and 200 ppm by mass or less.

DETAILED DESCRIPTION OF EMBODIMENTS

Hereinafter, one or more embodiments of the present invention will be described. However, the scope of the invention is not limited to the disclosed embodiments.

Note that the description will be made in the following order.

1. Electrostatic image developing toner
2. Developer

<1. Electrostatic Image Developing Toner>

Hereinafter, an electrostatic image developing toner according to a specific embodiment of the present invention will be described.

The electrostatic image developing toner (hereinafter also simply referred to as toner) contains toner particles formed by toner base particles. The toner particles may further contain an external additive attached to surfaces of the toner base particles, a colorant, a release agent, a charge control agent, and the like as necessary.

[Toner Base Particles]

The toner base particles mainly include a binder resin. The binder resin constituting the toner base particles contains an amorphous resin and a crystalline resin. The toner base particles contain at least an amorphous polyester resin as the amorphous resin. The toner base particles contain o-acetoacetaniside as a crystal nucleating agent of the crystalline resin contained as the binder resin. The toner base particles contain o-acetoacetaniside in an amount of 0.1 ppm by mass or more and 200 ppm by mass or less. The toner particles may further contain a colorant and the like as necessary.

The toner base particles are preferably a polymerized toner prepared in an aqueous medium rather than a pulverized toner from a viewpoint of appropriate control of a particle diameter and circularity, and more preferably toner base particles obtained by an emulsion association aggregation method.

[Binder Resin; Amorphous Resin]

As the amorphous resin contained in the toner base particles, an amorphous polyester resin may be used singly or in combination with another amorphous resin. The molecular weight of the amorphous resin is not particularly limited. Here, amorphous means that an endothermic curve obtained by differential scanning calorimetry (DSC) has a glass transition point (Tg) but no melting point, that is, no clear endothermic peak when the temperature rises. The clear endothermic peak means an endothermic peak having a half-value width of 15° C. or less in an endothermic curve when the temperature rises at a temperature rising rate of 10° C./min.

(Amorphous Polyester Resin)

An amorphous polyester resin may be used singly or in combination of two or more types thereof. The molecular weight of the amorphous polyester resin used is not specifically limited. As the amorphous polyester resin, two types of amorphous polyester resins consisting of an amorphous polyester resin having a high weight average molecular weight (Mw) (high molecular weight component) and an amorphous polyester resin having a low weight average molecular weight (low molecular weight component) are preferably used.

When the high molecular weight component and the low molecular weight component are used, the weight average molecular weight (Mw) of the high molecular weight component is preferably within a range of 30000 to 300000, more preferably within a range of 30000 to 200000, and still more preferably within a range of 35000 to 150000. The weight average molecular weight (Mw) of the low molecular weight component is preferably within a range of 8000 to 25000, more preferably within a range of 8000 to 22000, and still more preferably within a range of 9000 to 20000.

When the weight average molecular weights (Mw) of the high molecular weight component and the low molecular weight component are within the above ranges, compatibility between the high molecular weight component and the crystalline resin can be improved. For this reason, separation of the high molecular weight component and the crystalline resin which have become once compatible from each other can be adjusted. By using the high molecular weight component and the low molecular weight component, in manufacture of a toner by an emulsion polymerization aggregation method, an inclusion property of the high molecular weight component in the toner particles when aggregated particles obtained by aggregating raw material components are heated and fused is favorable. For this reason, it is possible to prevent the crystalline resin from being exposed to surfaces of the toner particles. Furthermore, a probability that a domain of the crystalline resin exists in the vicinity of surfaces of the toner particles is reduced. Therefore, it is considered that a charge amount distribution is not widened and toner scattering can be suppressed.

When the high molecular weight component and the low molecular weight component are mixed and used, a blending ratio therebetween (high molecular weight component:low molecular weight component) is preferably within a range of 35:65 to 95:5, more preferably within a range of 40:60 to 90:10, and still more preferably within a range of 50:50 to 85:15.

The high molecular weight component desirably contains alkenyl succinic acid or alkenyl succinic acid anhydride and trimellitic acid or trimellitic acid anhydride as a constituent monomer thereof. Alkenyl succinic acid and an anhydride thereof can be more easily compatible with the crystalline resin due to presence of a highly hydrophobic alkenyl group. Examples of alkenyl succinic acid include n-dodecenyl succinic acid, isododecenyl succinic acid, n-octenyl succinic acid, acid anhydrides thereof, acid chlorides thereof, and lower alkyl esters thereof each having 1 to 3 carbon atoms.

The high molecular weight component contains a trivalent or higher valent polycarboxylic acid as a constituent monomer thereof, and the high molecular chain thereby forms a crosslinked structure. By forming the crosslinked structure, the crystalline resin that has become once compatible with the high molecular weight component can be fixed to make it difficult to separate the crystalline resin from the high molecular weight component. Examples of the trivalent or higher valent polycarboxylic acid include hemimellitic acid, trimellitic acid, trimesic acid, merophanic acid, prehnitic acid, pyromellitic acid, mellitic acid, 1,2,3,4-butanetetracarboxylic acid, acid anhydrides thereof, acid chlorides thereof, and lower alkyl esters thereof each having 1 or more and 3 or less carbon atoms. As the trivalent or higher valent polycarboxylic acid, trimellitic acid is preferably used.

A method for manufacturing the amorphous polyester resin is not particularly limited, and a general polyester polymerization method is applicable. Examples of a polycarboxylic acid component used for synthesis of the amorphous polyester resin include: a saturated aliphatic dicarboxylic acid such as oxalic acid, malonic acid, succinic acid, adipic acid, sebacic acid, azelaic acid, n-dodecylsuccinic acid, nonanedicarboxylic acid, decanedicarboxylic acid, undecanedicarboxylic acid, dodecanedicarboxylic acid, or tetradecanedicarboxylic acid; an alicyclic dicarboxylic acid such as cyclohexanedicarboxylic acid; an aromatic dicarboxylic acid such as phthalic acid, isophthalic acid, or terephthalic acid; a trivalent or higher valent polycarboxylic acid such as trimellitic acid or pyromellitic acid; anhydrides of these carboxylic acid compounds; and alkyl esters of these carboxylic acid compounds, each having 1 to 3 carbon atoms. These compounds may be used singly or in combination of two or more types thereof.

Examples of an alcohol component used for synthesis of the amorphous polyester resin include: an aliphatic diol such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentyl glycol, or 1,4-butenediol; and a trihydric or higher hydric polyalcohol such as glycerin, pentaerythritol, trimethylolpropane, or sorbitol. These compounds may be used singly or in combination of two or more types thereof.

In addition to the above alcohol components, for example, bisphenol A, bisphenol A ethylene oxide adduct, bisphenol A propylene oxide adduct, hydrogenated bisphenol A, bisphenol S, bisphenol S ethylene oxide adduct, and bisphenol S propylene oxide adduct can be used. A bisphenol S derivative such as bisphenol S, bisphenol S ethylene oxide adduct, or bisphenol S propylene oxide adduct is preferably used from viewpoints of toner manufacturability, heat resistance, and transparency. Each of the carboxylic acid component and the alcohol component may contain a plurality of components. Particularly, use of bisphenol S can enhance heat resistance.

The glass transition point of the amorphous polyester resin as the high molecular weight component is preferably within a range of 45 to 75° C., more preferably within a range of 50 to 70° C., and still more preferably within a range of 55 to 66° C.

The glass transition point of the amorphous polyester resin as the low molecular weight component is preferably within a range of 45 to 75° C., more preferably within a range of 50 to 70° C., and still more preferably within a range of 55 to 65° C.

With the glass transition point of the amorphous resin within the above range, both low-temperature fixability and heat-resistant storage stability are achieved sufficiently.

Here, the glass transition point (Tg) can be measured using a differential scanning calorimeter, for example, diamond DSC (manufactured by Perkin Elmer Inc.). Specifically, 3.0 mg of a sample is sealed in an aluminum pan, and the temperature is changed in the order of heating, cooling, and heating. The temperature is raised from room temperature (25° C.) at the time of first heating and from 0° C. at the time of second heating to 200° C. at a temperature rising rate of 10° C./min and maintained at 150° C. for five minutes. At the time of cooling, the temperature is lowered from 200° C. to 0° C. at a temperature lowering rate of 10° C./min, and the temperature of 0° C. is maintained for five minutes. A baseline shift in a measurement curve obtained at the time of second heating is observed, and an intersection of an extension of the baseline before the shift and a tangent indicating a maximum slope of the shifted portion of the baseline is taken as a glass transition point (Tg). An empty aluminum pan is used as a reference.

The weight average molecular weight (Mw) of the amorphous polyester resin described above can be determined from a molecular weight distribution measured by gel permeation chromatography (GPC).

A sample is added to tetrahydrofuran (THF) so as to have a concentration of 1 mg/mL, dispersed for 15 minutes using an ultrasonic dispersing machine at 40° C., and then treated with a membrane filter having a pore size of 0.2 μm to prepare a sample solution. Tetrahydrofuran is caused to flow as a carrier solvent at a flow rate of 0.2 mL/min while a column temperature is maintained at 40° C. using a GPC device HLC-8120GPC (manufactured by Tosoh Corporation) and column TSK guard column+TSK gel Super HZM-M triplicate (manufactured by Tosoh Corporation). Together with the carrier solvent, 10 μL of the prepared sample solution is injected into the GPC device. The sample is detected using a refractive index detector (RI detector), and a molecular weight distribution of the sample is calculated using a calibration curve created by measurement with monodispersed polystyrene standard particles. The calibration curve is created by measuring 10 types of polystyrene standard particles (manufactured by Pressure Chemical Company) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, respectively.

By making the acid value of the amorphous polyester resin smaller than the acid value of the crystalline resin, alkoxyaniline can easily surround the crystalline resin, and dispersibility of the crystalline resin can be sufficiently enhanced. The acid value represents the mass of potassium hydroxide (KOH) necessary for neutralizing an acid contained in 1 g of a sample in units of mg. The acid value of the resin can be measured according to the method described in JIS K0070-1992 (potentiometric titration method). For measurement of the acid value of the amorphous polyester resin, a solvent in which tetrahydrofuran and isopropyl alcohol are mixed at a volume ratio of 1:1 can be used.

[Binder Resin; Crystalline Resin]

As the crystalline resin used for toner particles, any known crystalline resin can be used without limitation as long as being a resin exhibiting crystallinity Here, the crystallinity means that an endothermic curve obtained by differential scanning calorimetry (DSC) has a clear endothermic peak at a melting point, that is, when the temperature rises. The clear endothermic peak means a peak having a half-value width of 15° C. or less in an endothermic curve when the temperature rises at a temperature rising rate of 10° C./min.

The toner particles preferably contain a crystalline polyester resin as the crystalline resin from a viewpoint of improving low-temperature fixability of the toner particles. As the crystalline polyester resin, a resin exhibiting the crystallinity can be used among known polyester resins obtained by a polycondensation reaction between a polycarboxylic acid and a polyalcohol.

The polycarboxylic acid is a compound having two or more carboxy groups in one molecule. Examples thereof include: a saturated aliphatic dicarboxylic acid such as oxalic acid, malonic acid, succinic acid, adipic acid, sebacic acid, azelaic acid, n-dodecylsuccinic acid, nonanedicarboxylic acid, decanedicarboxylic acid, undecanedicarboxylic acid, dodecanedicarboxylic acid, or tetradecanedicarboxylic acid; an alicyclic dicarboxylic acid such as cyclohexanedicarboxylic acid; an aromatic dicarboxylic acid such as phthalic acid, isophthalic acid, or terephthalic acid; a trivalent or higher valent polycarboxylic acid such as trimellitic acid or pyromellitic acid; anhydrides of these carboxylic acid compounds; and alkyl esters of these carboxylic acid compounds, each having 1 to 3 carbon atoms. These compounds may be used singly or in combination of two or more types thereof.

The polyalcohol is a compound having two or more hydroxy groups in one molecule. Examples thereof include: an aliphatic diol such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentyl glycol, or 1,4-butenediol; and a trihydric or higher hydric polyalcohol such as glycerin, pentaerythritol, trimethylolpropane, or sorbitol. These compounds may be used singly or in combination of two or more types thereof.

The melting point (Tm) of the crystalline polyester resin is preferably lower than that of o-acetoacetaniside. The melting point (Tm) of the crystalline polyester resin is preferably 55 to 80° C., and more preferably 55 to 75° C. With the melting point of the crystalline polyester resin within the above range, low-temperature fixability is achieved sufficiently. Note that the melting point of the crystalline polyester resin can be controlled by the composition of the resin.

The melting point (Tm) of the crystalline polyester resin is the temperature at a peak top of an endothermic peak, and can be measured using a differential scanning calorimeter, for example, Diamond DSC (manufactured by Perkin Elmer Inc.).

Specifically, 3.0 mg of a sample is sealed in an aluminum pan, and the temperature is changed in the order of heating, cooling, and heating. The temperature is raised from room temperature (25° C.) at the time of first heating and from 0° C. at the time of second heating to 200° C. at a temperature rising rate of 10° C./min and maintained at 150° C. for five minutes. At the time of cooling, the temperature is lowered from 200° C. to 0° C. at a temperature lowering rate of 10° C./min, and the temperature of 0° C. is maintained for five minutes. The temperature (Tm) at a peak top of an endothermic peak in an endothermic curve obtained at the time of second heating is measured as the melting point.

The crystalline polyester resin preferably has a weight average molecular weight (Mw) within a range of 5000 to 50000, and a number average molecular weight (Mn) within a range of 1500 to 25000. The weight average molecular weight (Mw) and the number average molecular weight (Mn) of the crystalline polyester resin can be measured by the gel permeation chromatography (GPC) described above.

[o-Acetoacetaniside]

o-Acetoacetaniside contained in the toner base particles acts as a crystal nucleating agent (melting point: 85 to 87° C.) of the above-described crystalline resin in the toner base particles.

Generally, a crystal grows after a crystal nucleus is formed, and a crystal portion is formed. That is, in order to promote crystallization of the crystalline resin and to improve dispersibility of the crystalline resin, it is required to generate a crystal nucleus quickly and uniformly. Therefore, when the crystalline resin is crystallized from a molten state, desirably, "(1) the crystal nucleating agent already exists as a crystal nucleus (solid/crystal)", "(2) the crystal nucleating agent is uniformly dispersed in the toner particles", and "(3) the crystal nucleating agent maintains a structure capable of interacting with the crystalline resin".

The crystal nucleating agent preferably has a higher melting point than the crystalline resin. Since the melting point of the crystal nucleating agent is higher than that of the crystalline resin, when the crystalline resin is crystallized from a molten state, the crystal nucleating agent is likely to exist as a crystal nucleus (solid/crystal) earlier than the resin. For this reason, the resin causes crystal grow starting from the crystal nucleating agent existing as a crystal nucleus (solid/crystal), and the crystalline resin is easily manufactured. That is, in manufacture of the crystalline resin, since the melting point of o-acetoacetaniside is higher than that of the crystalline resin contained in the toner base particles, generation and growth of the crystalline resin are easily promoted. For example, the melting point of the crystalline polyester resin constituting the toner base particles is preferably lower than that of o-acetoacetaniside.

o-Acetoacetaniside is a low molecular weight compound, and therefore is more easily dispersed in a polyester resin of a toner binder and has a high affinity with the crystalline resin (crystalline polyester). Therefore, the crystalline resin can be quickly crystallized in a good dispersion state starting from o-acetoacetaniside. This makes it possible to ensure excellent low-temperature fixability in toner particles using the crystalline polyester.

o-Acetoacetaniside has structurally high affinity with an organic pigment, particularly with C.I. Pigment Yellow 74. For this reason, it is presumed that use of a colorant having high affinity with o-acetoacetaniside, such as C.I. Pigment Yellow 74, improves dispersibility of the colorant in the toner and improves image density.

(Content of o-Acetoacetaniside)

The content of o-acetoacetaniside in the toner base particles is 0.1 ppm by mass or more and 200 ppm by mass or less, preferably 0.1 ppm or more and 150 ppm by mass or less, and more preferably 0.1 ppm by mass or more and 100 ppm by mass or less. When the content of o-acetoacetaniside is less than 0.1 ppm by mass, it is difficult to sufficiently increase crystallinity of the crystalline resin, and it is difficult to maintain heat-resistant storage stability sufficiently. In addition, dispersibility of the colorant is hardly improved, and image density is hardly improved. When the content of o-acetoacetaniside is larger than 200 ppm by mass, o-acetoacetaniside excessively promotes crystallization of the crystalline polyester, resulting in an increase in a crystal domain of the crystalline polyester and deterioration of dispersibility of the crystalline resin. In addition, since dispersibility of the colorant is also deteriorated, it is difficult to obtain an effect of improving low-temperature fixability or image density.

The content of o-acetoacetaniside in the toner base particles can be adjusted by adding o-acetoacetaniside.

A commercially available colorant such as C.I. Pigment Yellow 74 used as a colorant of a toner may originally contain o-acetoacetaniside. In this case, the content in the colorant is specified in advance, and the colorant may be subjected to a pretreatment for reducing the content of o-acetoacetaniside, or o-acetoacetanisidide may be added to complement deficiency of o-acetoacetaniside such that the content of o-acetoacetaniside in the toner base particles is 0.1 ppm by mass or more and 150 ppm by mass or less.

The content of o-acetoacetaniside in the toner base particles can be measured by the following method. 10 mg of the toner base particles are weighed precisely in a 20 ml glass container, 1 ml of methanol is added thereto, and ultrasonic irradiation is performed for several seconds. Next, 4 ml of dimethyl sulfoxide (DMSO) is added. After ultrasonic irradiation for 20 minutes, the solution is filtered through a membrane filter to obtain an HPLC measurement solution. This HPLC measurement solution is detected under the following conditions using ultrafast HPLC.

Measurement Conditions

Column: Waters HSST3 2.1 mm i.d.*100 mmL, 1.8 μm

Temperature: 40° C.

Flow rate: 0.3 ml/min

Eluent: methanol/0.1 M ammonium acetate buffer (pH 5.0)

Gradient: methanol is used as eluent (A), and 0.1 M ammonium acetate buffer (pH 5.0) is used as eluent (B). Measurement is performed by setting a ratio of eluent (A) to eluent (B) (A/B) between 0 min and 5 min to 40/60, changing the ratio (A/B) from 40/60 to 100/0 between 5 to 15 min, and setting the ratio (A/B) to 100/0 between 15 to 30 min.

Injection volume: 2 μl,

Detection: UV 280 nm

Quantification is performed by an absolute calibration curve method using an authentic sample of o-acetoacetaniside.

[Other Constituent Materials of Toner Base Particles]

The toner base particles may contain other components such as a colorant in addition to the above-described crystalline resin, amorphous resin, and o-acetoacetaniside.

(Colorant)

As the colorant, an inorganic or organic colorant known as a colorant of toner particles can be used. Examples of the colorant include carbon black, a magnetic material, a pigment, and a dye. The colorant may be used singly or in combination of two or more types thereof. The toner particles preferably contain C.I. Solvent Yellow 74 as the colorant from a viewpoint of improving the above-described colorant dispersibility by o-acetoacetaniside. The content of the colorant is preferably 1% by mass or more and 20% by mass or less with respect to 100% by mass of the toner base particles.

Examples of the carbon black include channel black, furnace black, acetylene black, thermal black, and lamp black.

Examples of the magnetic material include a ferromagnetic metal such as iron, nickel, or cobalt, an alloy containing these metals, and a ferromagnetic metal compound such as ferrite or magnetite.

Examples of the pigment include C.I. Pigment Red 2, C.I. Pigment Red 3, C.I. Pigment Red 5, C.I. Pigment Red 7, C.I. Pigment Red 15, C.I. Pigment Red 16, C.I. Pigment Red 48:1, C.I. Pigment Red 48:3, C.I. Pigment Red 53:1, C.I. Pigment Red 57:1, C.I. Pigment Red 81:4. C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 208, C.I. Pigment Red 209, C.I. Pigment Red 222, C.I. Pigment Red 238, C.I. Pigment Red 269, C.I. Pigment Orange 31, C.I. Pigment Orange 43, C.I. Pigment Yellow 3, C.I. Pigment Yellow 9, C.I. Pigment Yellow 14, C.I. Pigment Yellow 17, C.I. Pigment Yellow 35, C.I. Pigment Yellow 36, C.I. Pigment Yellow 65, C.I. Pigment Yellow 74, C.I. Pigment Yellow 83, C.I. Pigment Yellow 93, C.I. Pigment Yellow 94, C.I. Pigment Yellow 98, C.I. Pigment Yellow 110, C.I. Pigment Yellow 111, C.I. Pigment Yellow 138, C.I. Pigment Yellow 139, C.I. Pigment Yellow 153, C.I. Pigment Yellow 155, C.I. Pigment Yellow 180, C.I. Pigment Yellow 181, C.I. Pigment Yellow 185, C.I. Pigment Green 7, C.I. Pigment Blue 15:3, C.I. Pigment Blue 15:4, C.I. Pigment Blue 60, and a phthalocyanine pigment including zinc, titanium, magnesium, or the like as a central metal.

Examples of the dye include C.I. Solvent Red 1, C.I. Solvent Red 3, C.I. Solvent Red 14, C.I. Solvent Red 17, C.I. Solvent Red 18, C.I. Solvent Red 22, C.I. Solvent Red 23, C.I. Solvent Red 49, C.I. Solvent Red 51, C.I. Solvent Red 52, C.I. Solvent Red 58, C.I. Solvent Red 63, C.I. Solvent Red 87, C.I. Solvent Red 111, C.I. Solvent Red 122, C.I. Solvent Red 127, C.I. Solvent Red 128, C.I. Solvent Red 131, C.I. Solvent Red 145, C.I. Solvent Red 146, C.I. Solvent Red 149, C.I. Solvent Red 150, C.I. Solvent Red 151, C.I. Solvent Red 152, C.I. Solvent Red 153, C.I. Solvent Red 154, C.I. Solvent Red 155, C.I. Solvent Red 156, C.I. Solvent Red 157, C.I. Solvent Red 158, C.I. Solvent Red 176, C.I. Solvent Red 179, a pyrazolotriazole azo dye, a pyrazolotriazole azomethine dye, a pyrazolone azo dye, a pyrazolone azomethine dye, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, and C.I. Solvent Blue 95.

[Constituent Material of Toner Particles]

The toner particles may contain, in addition to the above-described toner base particles, other components such as an external additive, a release agent, and a charge control agent.

(External Additive)

The toner particles may contain, in addition to the toner base particles, an external additive existing on surfaces of the toner base particles. Fluidity, chargeability, and the like of the toner particles can be controlled by the external additive. The external additive may be used singly or in combination of two or more types thereof. Examples of the external additive include silica particles, titania particles, alumina particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles.

The surface of the external additive has been preferably hydrophobized. As the hydrophobizing treatment, a surface treatment using a known surface treatment agent can be performed. The surface treatment agent may be used singly or in combination of two or more types thereof. Examples of the surface treatment agent include a silane coupling agent, a silicone oil, a titanate-based coupling agent, an aluminate-based coupling agent, a fatty acid, a fatty acid metal salt, esterified products thereof, and rosin acid.

Examples of the silane coupling agent include dimethyldimethoxysilane, hexamethyldisilazane (HMDS), methyltrimethoxysilane, isobutyltrimethoxysilane, and decyltrimethoxysilane.

Examples of the silicone oil include a cyclic compound and a linear or branched organosiloxane. More specific examples thereof include organosiloxane oligomer, octamethylcyclotetrasiloxane, decamethylcyclopentasiloxane, tetramethylcyclohtetrasiloxane, and tetravinyltetramethylcyclotetrasiloxane.

The silicone oil includes a silicone oil in which at least a terminal is modified, and includes, for example, a highly reactive silicone oil in which a modifying group is introduced into a side chain, one terminal, both terminals, a side chain one terminal, or side chain both terminals. The modifying group may be introduced singly or in combination of two or more types thereof. Examples of the modifying group include an alkoxy group, a carboxyl group, a carbinol group, a higher fatty acid modifying group, a phenyl group, an epoxy group, a methacryl group, and an amino group.

The addition amount of the external additive (the total addition amount when a plurality of external additives is used) is preferably 0.1% by mass or more and 10.0% by mass or less, and more preferably 1.0% by mass or more and 3.0% by mass or less with respect to the entire toner particles.

(Release Agent)

Examples of the release agent (wax) include a hydrocarbon-based wax and an ester wax. Examples of the hydrocarbon-based wax include a low molecular weight polyethylene wax, a low molecular weight polypropylene wax, a Fischer-Tropsch wax, a microcrystalline wax, and a paraffin wax. Examples of the ester wax include a carnauba wax, pentaerythritol behenate, behenyl behenate, and behenyl citrate.

The content of the release agent is preferably 1 part by mass or more and 30 parts by mass or less, and more preferably 5 parts by mass or more and 20 parts by mass or less with respect to 100 parts by mass of the binder resin. The content of the release agent in the toner particles is preferably 3% by mass or more and 15% by mass or less. The content of the release agent within the above range makes it possible to obtain fixing separability sufficiently.

(Charge Control Agent)

Examples of the charge control agent include a known compound such as a nigrosine-based dye, a metal salt of naphthenic acid or a higher fatty acid, an alkoxylated amine, a quaternary ammonium salt, an azo-based metal complex, a salicylic acid metal salt, or a salicylic acid metal complex. Use of the charge control agent makes it possible to obtain a toner having excellent charging characteristics. The content of the charge control agent is preferably 0.1 parts by mass or more and 5.0 parts by mass or less with respect to 100 parts by mass of the binder resin.

[Particle Diameter and Circularity of Toner Particle]

The size (particle diameter) and shape (circularity) of the toner particle can be appropriately determined within a range in which various effects such as the above-described low-temperature fixability and image density can be obtained.

An average particle diameter of the toner particles is preferably 3.0 μm or more and 8.0 μm or less, and more preferably 5.0 μm or more and 8.0 μm or less in terms of a volume-based median diameter ($d_{50}$). Within the above range, high image density can be obtained even with a very small dot image at a 1200 dpi level. Note that the average particle diameter of the toner particles can be adjusted by the temperature and stirring conditions in manufacture of the toner particles, classification of the toner particles, mixing of classified toner particles, and the like.

The volume-based median diameter ($d_{50}$) of the toner particles can be measured and calculated using a device in which a computer system for data processing (for example, data processing software Software V3.51) is connected to "Multisizer 3" (manufactured by Beckman Coulter, Inc.).

Specifically, a measurement sample (toner) is added to a surfactant solution (for the purpose of dispersing the toner particles, for example, a surfactant solution obtained by diluting a neutral detergent containing a surfactant component 10 times with pure water) and familiarized. Thereafter, the resulting solution is subjected to ultrasonic dispersion to prepare a toner particle dispersion. This toner particle dispersion is injected into a beaker containing "ISOTON II" (manufactured by Beckman Coulter, Inc.) in a sample stand with a pipette until a display concentration of the measuring device reaches 8%. By setting the display concentration to 8%, a reproducible measured value can be obtained. Then, in the measuring device, the count number of measurement particles is set to 25000, an aperture diameter is set to 100 μm, a measurement range of 2 to 60 μm is divided into 256 parts, and a frequency value is calculated. A particle diameter of 50% from a larger volume integration fraction is taken as the volume-based median diameter ($d_{50}$).

The toner particles preferably have an average circularity of 0.920 or more and 1.000 or less. If the average circularity is within the above range, the toner particles are less likely to be crushed. This makes it possible to suppress contamination of a frictional charge imparting member, to stabilize chargeability of the toner, and to enhance image quality of a formed image.

The average circularity of the toner particles can be measured using, for example, a flow particle image analyzer "FPIA-3000" (manufactured by Sysmex Corporation). Specifically, a measurement sample (toner) is familiarized with an aqueous solution containing a surfactant, and is subjected to an ultrasonic dispersion treatment for one minute to be dispersed. Thereafter, the resulting solution is photographed using "FPIA-2100" (manufactured by Sysmex Corporation) under measurement conditions: HPF (high magnification imaging) mode at an appropriate concentration of 3,000 to 10,000 HPF detection numbers. If the HPF detection number is within the above range, a reproducible measurement value can be obtained. The average circularity of the toner particles can be determined by dividing the sum of circularities C calculated from the following formula (c) using a circumference (L1) of a circle having the same projected area as the particle image and a circumference (L2) of the particle projection image in a predetermined number of toner particles by the predetermined number in the photographed particle image. The average circularity of the toner particles can be adjusted by, for example, the degree of aging of the resin particles in manufacture of the toner particles, a heat treatment of the toner particles, mixing of toner particles having different circularities, and the like.

$$C=(L1)/(L2) \qquad \text{Formula (c):}$$

[Dispersion State of Crystalline Resin of Toner Particles]

A dispersion state of the crystalline resin of the toner particles can be examined by measuring the domain diameter of the crystalline resin in cross section of the toner particles. The cross section of the toner particles can be observed by a known method such as a transmission electron microscope (TEM) or a scanning probe microscope (SPM). Hereinafter, an example of a method for observing the cross section of the toner particles will be described. Note that the method for observing the cross section of the toner particles is not limited to this method as long as being able to perform similar observation.

(Observation Conditions)

The cross section of the toner particles can be observed under the following observation conditions.

Device: electron microscope "JSM-7401F" (manufactured by JEOL Ltd.)

Sample: section of toner particles stained with ruthenium tetroxide ($RuO_4$) (thickness of section: 60 to 100 nm)

Acceleration voltage: 30 kV

Magnification: 50000 times, bright field image (Method for Manufacturing Sample)

3 parts by mass of the manufactured toner is added to and dispersed in 35 parts by mass of a 0.2% polyoxyethyl phenyl ether aqueous solution. Thereafter, the resulting solution is treated with an ultrasonic wave (US-1200T manufactured by Nippon Seiki Seisakusho) at 25° C. for five minutes, and an external additive is removed from surfaces of the toner particles to obtain toner base particles for observation.

Next, 1 to 2 mg of the obtained toner base particles are put in a 10 mL sample bottle such that the toner base particles spread, dispersed in a photocurable resin "D-800" (manufactured by JEOL Ltd.), and photocured to form a block. Next, the manufactured block is stained under ruthenium tetroxide ($RuO_4$) vapor staining conditions illustrated below. Thereafter, an ultrathin piece-shaped sample having a thickness of 60 to 100 nm is cut out from the block using a microtome having diamond teeth.

(Ruthenium Tetroxide Staining Conditions)

Staining with ruthenium tetroxide ($RuO_4$) is performed using a vacuum electron staining device VSC1R1 (manufactured by Filgen, Inc.). In accordance with device procedures, a sublimation chamber containing ruthenium tetroxide ($RuO_4$) is disposed in a main body of the staining device. The manufactured block is introduced into the staining chamber, and then stained under conditions of room temperature (24 to 25° C.), concentration 3 (300 Pa), and a time period of ten minutes.

(Observation of Crystal Structure)

Within 24 hours after staining, the stained sample is observed with a transmission electron detector using an electron microscope "JSM-7401F" (manufactured by JEOL Ltd.). Here, domains in the toner particles can be discriminated by a difference in contrast stained with ruthenium tetroxide. Among the observed domains, a lightly stained domain part is observed as a domain of the release agent, and a deeply stained domain part is observed as a domain of the crystalline resin.

(Method for Measuring Domain of Crystalline Resin)

An average domain diameter of the crystalline resin can be calculated from an image observed by the above method, for example, using commercially available image processing software.

Specifically, a photographic image of a cross section of toner particles manufactured by the above method is captured with a scanner, and an equivalent circle diameter of a domain of the crystalline resin (domain deeply stained with $RuO_4$) is determined using an image processing analyzer LUZEX AP (manufactured by Nireco Corporation).

100 toner particles are measured, and an arithmetic average value of the measured 100 toner particles is calculated. Here, at the time of measurement, a cross section of toner particles to be selected within ±10% (for example, 6.3 μm±0.63 μm) of the volume average particle diameter of the toner particles is selected.

[Method for Manufacturing Electrostatic Image Developing Toner]

Examples of a method for manufacturing an electrostatic image developing toner include a suspension polymerization method, an emulsion aggregation method, and other known methods. In manufacturing an electrostatic image developing toner, the emulsion aggregation method is preferably used. Use of the emulsion aggregation method makes it possible to manufacture toner particles having small diameters stably at low manufacturing cost.

The method for manufacturing toner particles by the emulsion aggregation method forms toner particles by mixing an aqueous dispersion of amorphous resin particles, an aqueous dispersion of crystalline resin particles, and an aqueous dispersion of colorant particles containing o-acetoacetaniside, and aggregating the amorphous resin particles, the crystalline resin particles, and the colorant particles. At this time, the crystalline resin can be aggregated using o-acetoacetaniside as a crystal nucleating agent.

Hereinafter, as an example of the method for manufacturing toner particles by the emulsion aggregation method, a method for manufacturing toner particles through the following steps (1) to (9) will be described.

(Step (1); Preparation of Aqueous Dispersion of Amorphous Polyester Resin Particles)

In step (1), an aqueous dispersion of amorphous polyester resin particles is prepared as a dispersion of the amorphous resin. Here, as the amorphous resin, when two types of amorphous resins consisting of an amorphous polyester resin having a high weight average molecular weight (Mw) (high molecular weight component) and an amorphous polyester resin having a low weight average molecular weight (low molecular weight component) are used, the amorphous resin dispersions thereof are prepared separately.

Specifically, an amorphous polyester resin is synthesized, dissolved or dispersed in an organic solvent to prepare an oil phase liquid, and this oil phase liquid is phase-inverted and emulsified to form amorphous polyester resin particles in an aqueous medium. Emulsion dispersion of the oil phase liquid can be performed using mechanical energy. The particle diameter of an oil droplet is controlled to a desired particle diameter. Thereafter, the organic solvent is removed, and an aqueous dispersion of the amorphous polyester resin can be thereby obtained.

The organic solvent used for the oil phase liquid preferably has a low boiling point and low solubility in water from a viewpoint of easiness of a removal treatment after formation of oil droplets. Specific examples of the organic solvent include methyl acetate, ethyl acetate, methyl ethyl ketone, methyl isobutyl ketone, toluene, and xylene. These compounds may be used singly or in combination of two or more types thereof.

The amount of the organic solvent used is usually within a range of 1 to 300 parts by mass with respect to 100 parts by mass of the amorphous polyester resin.

(Step (2); Preparation of Aqueous Dispersion of Crystalline Resin Particles)

In step (2), an aqueous dispersion of the crystalline resin particles is prepared. In the following description, a case where a crystalline polyester resin is used as the crystalline resin will be described.

The aqueous dispersion of the crystalline polyester resin particles can be prepared in a similar manner to the aqueous dispersion of the amorphous polyester resin. The crystalline polyester resin particles preferably have an average particle diameter within a range of 100 to 400 nm in terms of a volume-based median diameter ($d_{50}$). The volume-based median diameter ($d_{50}$) of the crystalline polyester resin particles can be measured using Microtrack UPA-150 (manufactured by Nikkiso Co., Ltd.).

(Step (3); Preparation of Aqueous Dispersion of Colorant Particles)

In step (3), a colorant is dispersed in a form of fine particles in an aqueous medium to prepare an aqueous dispersion of colorant particles. In this step, o-acetoacetaniside is added such that the content of o-acetoacetaniside in the toner particles is finally within a predetermined range in terms of ppm by mass By adding o-acetoacetaniside together with the colorant particles to prepare an aqueous dispersion, dispersibility of o-acetoacetaniside can be improved because affinity between the colorant and o-acetoacetaniside is high.

Note that o-acetoacetaniside may be prepared in a separate step without being added to the aqueous dispersion of the colorant particles.

When o-acetoacetaniside is contained in a commercially available pigment such as C.I. Pigment Yellow 74, the content of o-acetoacetaniside contained in the pigment is specified in advance, and the addition amount of o-acetoacetaniside is adjusted such that the content of o-acetoacetaniside in the toner particles is within a desired range. For example, a pigment (for example, C.I. Pigment Yellow 74) is pretreated (washed with ethanol) to reduce the content of o-acetoacetaniside in the pigment. The content of o-acetoacetaniside may be increased by adding o-acetoacetaniside to the pigment.

The aqueous dispersion of the colorant particles can be prepared by dispersing the colorant in an aqueous medium containing a surfactant at a concentration equal to or higher than a critical micelle concentration (CMC). The colorant can be dispersed using mechanical energy. A dispersing machine used for dispersion of the colorant is not particularly limited, but preferable examples thereof include an ultrasonic dispersing machine, a mechanical homogenizer, a pressurizing dispersing machine such as a Manton Gaulin or a pressure type homogenizer, a sand grinder, and a medium type dispersing machine such as a Getzmann mill or a diamond fine mill.

The colorant particles in the aqueous dispersion preferably have a volume-based median diameter ($d_{50}$) within a range of 10 to 300 nm, more preferably within a range of 100 to 200 nm, particularly preferably within a range of 100 to 150 nm. The volume-based median diameter ($d_{50}$) of the colorant particles can be measured using Microtrack UPA-150 (manufactured by Nikkiso Co., Ltd.).

(Step (4); Aggregation of Particles)

In step (4), the amorphous resin particles, the crystalline polyester resin particles, the colorant particles, and other toner constituent particles are aggregated to form toner particles. Specifically, the aqueous dispersion containing the particles (amorphous resin particles, crystalline polyester resin particles, and colorant particles) prepared in the above steps (1) to (3) is mixed with an aqueous medium. Then, a flocculant having a concentration equal to or higher than a critical aggregation concentration is added to the mixed aqueous medium containing the particles, and the temperature is raised to the glass transition temperature (Tg) or higher of the amorphous resin particles to aggregate the particles.

A flocculant to be used is not particularly limited, but is preferably selected from metal salts such as an alkali metal salt and an alkaline-earth metal salt. Examples of the metal salt include a monovalent metal salt formed of sodium, potassium, or lithium, a divalent metal salt formed of calcium, magnesium, manganese, or copper, and a trivalent metal salt formed of iron or aluminum. Specific examples thereof include sodium chloride, potassium chloride, lithium chloride, calcium chloride, magnesium chloride, zinc chloride, copper sulfate, magnesium sulfate, and manganese sulfate. Among these metal salts, a divalent metal salt is preferably used because aggregation can be promoted with a smaller amount. These metal salts may be used singly or in combination of two or more types thereof.

(Step (5); Aging Treatment of Toner Particles)

In step (5), the toner particles formed in step (4) are aged to control the toner particles so as to have desired shapes. Step (5) can be performed as necessary. Specifically, the dispersion of the toner particles obtained in step (4) is heated and stirred, and heating temperature, stirring speed, heating time, and the like are adjusted such that the toner particles each have a desired circularity.

(Step (4B); Formation of Core-Shell Structure)

Step (4B) can be performed when toner particles each having a core-shell structure are formed. In step (4B), by using the toner particles obtained in step (4) or (5) as core particles, a shell layer coating at least a part of a surface of each of the core particles is formed to form toner particles each having a core-shell structure.

When toner particles each having a core-shell structure are formed, a resin constituting the shell layer is dispersed in an aqueous medium to prepare a dispersion of the resin particles of the shell layer. The prepared dispersion is added to the dispersion of the toner particles obtained in step (4) or (5) above, and the resin particles of the shell layer are aggregated and fused to surfaces of the toner particles. As a result, a dispersion of the toner particles each having a core-shell structure can be obtained.

In order to more strongly aggregate and fuse the resin particles of the shell layer to the core particles, heat treatment may be performed following the shelling step. The heat treatment can be performed until toner particles having a desired circularity are obtained.

The core-shell structure means a multilayer structure including a core particle formed of a toner particle and a shell layer coating a surface of the core particle. The shell layer does not have to coat the entire surface of the core particle, and the core particle may be partially exposed. The cross section of the core-shell structure can be confirmed by a known observation means such as a transmission electron microscope (TEM) or a scanning probe microscope (SPM).

(Step (6); Cooling Treatment)

In step (6), the dispersion of the toner particles that have been aggregated in step (4) and have been subjected to steps (5) and (4B) as necessary are cooled. As a condition of the cooling treatment, cooling is preferably performed at a cooling rate of 1 to 20° C./min. A specific method for the cooling treatment is not particularly limited, and examples thereof include a method for introducing a refrigerant from the outside of a reaction vessel for cooling and a method for directly putting cold water into a reaction system for cooling.

During this cooling, if the melting point of o-acetoacetaniside is higher than that of the crystalline resin, o-acetoacetaniside is precipitated before the crystalline resin is precipitated. Then, the crystalline resin particles are aggregated using o-acetoacetaniside that has been precipitated first as a crystal nucleating agent. For this reason, the resin causes crystal grow starting from precipitated o-acetoacetaniside, and the resin quickly crystallizes in a good dispersion state. This makes it possible to impart excellent low-temperature fixability to the toner particles using the crystalline resin.

(Step (7); Separation of Toner Particles)

In step (7), the toner particles are solid-liquid separated from the cooled dispersion of the toner particles. Then, deposits such as a surfactant and a flocculant are removed from a toner cake (wet toner particles formed into a cake shape) obtained by solid-liquid separation, and the toner cake is washed. A method for solid-liquid separating the toner particles is not particularly limited, and examples thereof include a centrifugal separation method, a reduced pressure filtration method using Nutsche or the like, and a filtration method using a filter press or the like. Further, in washing the toner cake, the toner cake is preferably washed with water until the electric conductivity of a filtrate reaches 10 μS/cm.

(Step (8); Drying)

In step (8), the washed toner cake is dried. For drying the toner cake, a spray dryer, a vacuum freeze dryer, a reduced pressure dryer, or the like can be used. Specifically, a stationary shelf dryer, a mobile shelf dryer, a fluidized bed dryer, a rotary dryer, a stirring dryer, or the like is preferably used.

The moisture content of the dried toner particles is preferably 5% by mass or less, and more preferably 2% by mass or less. Note that in a case where the dried toner particles are aggregated with weak inter-particle attraction, the aggregate may be disintegrated. For the disintegrating treatment, a mechanical disintegrating device such as a jet mill, a Henschel mixer, a coffee mill, or a food processor can be used.

(Step (9); Addition of External Additive)

In step (9), an external additive is added to the toner particles. Step (9) can be performed as necessary. For adding the external additive, a mechanical mixing device such as a Henschel mixer or a coffee mill can be used.

<2. Developer>

Hereinafter, a developer using the electrostatic image developing toner according to a specific embodiment will be described.

The developer may be a one-component developer or a two-component developer. The one-component developer is formed of the above-described toner particles. The two-component developer is formed of toner particles and carrier particles.

[Two-Component Developer]

The two-component developer can be manufactured by mixing an appropriate amount of toner particles and an appropriate amount of carrier particles. Examples of a mixing device used for mixing the toner particles and the carrier particles include a Nauta mixer, a W cone, and a V-type mixer.

The content (toner concentration) of the toner particles in the two-component developer may be similar to that of a normal two-component developer, and is, for example, 4.0 to 8.0% by mass.

A mixing ratio (mass ratio) between the toner particles and the carrier particles is not particularly limited, but the ratio of toner particles:carrier particles is preferably 1:100 to 30:100, and more preferably 3:100 to 20:100 from viewpoints of chargeability and storage stability.

[Carrier Particles]

Examples of the carrier particle include a magnetic particle formed of a conventionally known material, for example, a metal such as iron, ferrite, or magnetite, or an alloy formed of these metals and a metal such as aluminum or lead. Examples of the carrier particle include a coating type carrier particle including a core material particle formed of a magnetic material and a coating material layer coating a surface of the core material particle, and a resin dispersion type carrier particle in which fine powders of a magnetic material are dispersed in a resin. The carrier particle is preferably the coating type carrier particle from a viewpoint of suppressing adhesion of the carrier particle to a photoreceptor described later.

(Core Material Particle)

The core material particle is, for example, a magnetic material that is strongly magnetized in a direction of a magnetic field by the magnetic field. The magnetic material may be used singly or in combination of two or more types thereof. Examples of the magnetic material include a ferromagnetic metal such as iron, nickel, or cobalt, an alloy or a compound containing these metals, and an alloy that exhibits ferromagnetism by a heat treatment.

Examples of the ferromagnetic metal and a compound containing the metal include iron, ferrite represented by the following formula (a), and magnetite represented by the following formula (b). In formulas (a) and (b), M represents one or more monovalent or divalent metals selected from Mn, Fe, Ni, Co, Cu, Mg, Zn, Cd, and Li.

$MO.Fe_2O_3$ Formula (a):

$MFe_2O_4$ Formula (b):

Examples of the ferromagnetic alloy include a Hensler alloy such as manganese-copper-aluminum or manganese-copper-tin, and chromium dioxide.

As the core material particles, various ferrites are preferable. The specific gravity of the coating type carrier particles is lower than that of a metal constituting the core material particles. Therefore, various ferrites can reduce an impact force of stirring in a developing device.

(Coating Material)

The coating material may be used singly or in combination of two or more types thereof. As the coating material, a conventionally known resin used for coating the core material particle in the carrier particle can be used. The coating material is preferably a resin having a cycloalkyl group from viewpoints of reducing the moisture adsorbability of the carrier particles and increasing adhesion with the core material particles in the coating layer. Examples of the cycloalkyl group include a cyclohexyl group, a cyclopentyl group, a cyclopropyl group, a cyclobutyl group, a cycloheptyl group, a cyclooctyl group, a cyclononyl group, and a cyclodecyl group. As the cycloalkyl group, a cyclohexyl group and a cyclopentyl group are preferable. Furthermore, a cyclohexyl group is more preferable from a viewpoint of adhesion between the coating layer and the ferrite particles.

The weight average molecular weight Mw of the resin having a cycloalkyl group is preferably, for example, 10000 to 800000, and more preferably 100000 to 750000. The content of the cycloalkyl group in the resin is, for example, 10 to 90% by mass. The content of the cycloalkyl group in the resin can be determined by a known instrumental analysis method such as P-GC/MS or $^1$H-NMR.

The particle diameter and shape of the carrier particle can be appropriately determined within a range where the effects of the present embodiment can be obtained. For example, the average particle diameter of the carrier particles is preferably 20 to 100 μm, and more preferably 25 to 80 μm in terms of volume-based median diameter ($d_{50}$). The volume average particle diameter of the carrier particles can be measured by a wet method using, for example, a laser diffraction particle size distribution measuring device "HELOS" (manufactured by Nippon Laser Corporation). The volume average particle diameter of the carrier particles can be adjusted by, for example, a method for controlling the particle diameters of the core material particles according to conditions for manufacturing the core material particles, classification of the carrier particles, mixing of classified products of the carrier particles, or the like.

EXAMPLES

Hereinafter, the present invention will be specifically described with reference to Examples, but the present invention is not limited thereto. Note that expressions of "part" and "%" used in Examples mean "part by mass" and "% by mass", respectively, unless otherwise specified.

In the following Examples, amorphous polyester resins (A1) and (A2) were manufactured, and then amorphous polyester resin dispersions (A1E) and (A2E) were prepared. Crystalline resins (C1) to (C3) were manufactured, and then crystalline resin dispersions (C1E) to (C3E) were prepared. Furthermore, release agent particle dispersion (W1) and colorant particle dispersions (P1) to (P8) were prepared.

Then, toner particles (1) to (11) were manufactured using the prepared amorphous polyester resin dispersions (A1E) and (A2E), crystalline resin dispersions (C1E) to (C3E), release agent particle dispersion (W1), and colorant particle dispersions (P1) to (P8). Furthermore, developers (1) to (12) were manufactured using toner particles (1) to (11).

<Manufacture of Amorphous Polyester Resin (A1)>

The following polycarboxylic acid monomer and polyalcohol monomer were put into a reaction vessel equipped with a stirrer, a nitrogen introduction tube, a temperature sensor, and a rectifying tower, and the internal temperature was raised to 190° C. over one hour while stirring. It was confirmed that the inside of the reaction system was uniformly stirred. Thereafter, $Ti(OBu)_4$ as a catalyst was put thereinto in an amount of 0.004% by mass with respect to the total amount of the polycarboxylic acid monomer.

Furthermore, the internal temperature was raised from 190° C. to 240° C. over six hours while generated water was distilled, and a dehydration condensation reaction was further continued at 240° C. for 10 hours to perform polymerization. Thereafter, the pressure was reduced to obtain amorphous polyester resin (A1). The weight average molecular weight (Mw) of this resin was 68000. The acid value of this resin was 15 mg KOH/g.

(Polycarboxylic Acid Monomer)

Terephthalic acid (TPA): 15 parts by mass

Fumaric acid (FA): 30 parts by mass

Dodecenyl succinic acid (DDSA): 3 parts by mass

Trimellitic acid (TMA): 10 parts by mass (Polyalcohol Monomer)

2,2-bis(4-hydroxyphenyl) propaneethylene oxide 2-molar adduct (BPA-EO): 20 parts by mass 2,2-bis(4-hydroxyphenyl) propanepropylene oxide 2-molar adduct (BPA-PO): 70 parts by mass <Manufacture of Amorphous Polyester Resin (A2)>

The following polycarboxylic acid monomer and polyalcohol monomer were put into a reaction vessel equipped with a stirrer, a nitrogen introduction tube, a temperature sensor, and a rectifying tower, and the internal temperature was raised to 190° C. over one hour while stirring. It was confirmed that the inside of the reaction system was uniformly stirred. Thereafter, $Ti(OBu)_4$ as a catalyst was put thereinto in an amount of 0.004% by mass with respect to the total amount of the polycarboxylic acid monomer.

Furthermore, the internal temperature was raised from 190° C. to 240° C. over six hours while generated water was distilled, and a dehydration condensation reaction was further continued at 240° C. for six hours to perform polymerization. Thereafter, the pressure was reduced to obtain amorphous polyester resin (A2). The weight average molecular weight (Mw) of this resin was 21000.

(Polycarboxylic Acid Monomer)

Terephthalic acid (TPA): 60 parts by mass

Dodecenyl succinic acid (DDSA): 5 parts by mass

Trimellitic acid (TMA): 7 parts by mass (Polyalcohol Monomer)

2,2-bis(4-hydroxyphenyl) propaneethylene oxide 2-molar adduct (BPA-EO): 30 parts by mass 2,2-bis(4-hydroxyphenyl) propanepropylene oxide 2-molar adduct (BPA-PO): 60 parts by mass <Manufacture of Crystalline Resin (C1)>

Into a four-necked flask equipped with a nitrogen introduction tube, a dehydration tube, a stirrer, and a thermocouple, 137 parts by mass of adipic acid and 152 parts by mass of 1,9-nonanediol were put, and heated to 170° C. and dissolved. Thereafter, 1.2 parts by mass of $Ti(OBu)_4$ as a catalyst was added thereto, and the temperature was raised to 235° C. under a nitrogen gas atmosphere. A reaction was performed at normal pressure (101.3 kPa) for five hours and further performed under reduced pressure (8 kPa) for one hour. Next, the obtained reaction solution was cooled to 200° C. and then was caused to react for one hour under reduced pressure (20 kPa) to obtain crystalline resin (C1). The weight average molecular weight Mw of crystalline resin (C1) was 14500, and the melting point Tc thereof was 62° C.

<Manufacture of Crystalline Resin (C2)>

Into a four-necked flask equipped with a nitrogen introduction tube, a dehydration tube, a stirrer, and a thermocouple, 137 parts by mass of adipic acid and 130 parts by mass of 1,9-nonanediol were put, and heated to 170° C. and dissolved. Thereafter, 1.2 parts by mass of $Ti(OBu)_4$ as a catalyst was added thereto, and the temperature was raised to 235° C. under a nitrogen gas atmosphere. A reaction was performed at normal pressure (101.3 kPa) for five hours and further performed under reduced pressure (8 kPa) for one hour. Next, the obtained reaction solution was cooled to 200° C. and then was caused to react for one hour under reduced pressure (20 kPa) to obtain crystalline resin (C2). The weight average molecular weight Mw of crystalline resin (C2) was 31000, and the melting point Tc thereof was 70° C.

<Manufacture of Crystalline Resin (C3)>

Into a four-necked flask equipped with a nitrogen introduction tube, a dehydration tube, a stirrer, and a thermocouple, 115 parts by mass of adipic acid and 152 parts by mass of 1,9-nonanediol were put, and heated to 170° C. and dissolved. Thereafter, 1.2 parts by mass of $Ti(OBu)_4$ as a catalyst was added thereto, and the temperature was raised to 235° C. under a nitrogen gas atmosphere. A reaction was performed at normal pressure (101.3 kPa) for five hours and further performed under reduced pressure (8 kPa) for one hour. Next, the obtained reaction solution was cooled to 200° C. and then was caused to react for one hour under reduced pressure (20 kPa) to obtain crystalline resin (C3). The weight average molecular weight Mw of crystalline resin (C3) was 9900, and the melting point Tc thereof was 57° C.

<Preparation of Dispersion (A1E) of Amorphous Polyester Resin (A1)>

200 parts by mass of amorphous polyester resin (A1) was dissolved in 200 parts by mass of ethyl acetate. Then, while this solution was stirred, an aqueous solution obtained by dissolving sodium polyoxyethylene lauryl ether sulfate in 800 parts by mass of deionized water so as to have a concentration of 1% by mass was slowly added dropwise to the above solution. Next, ethyl acetate was removed from the obtained solution under reduced pressure, and then the pH was adjusted to 8.5 with ammonia. Thereafter, the solid content concentration was adjusted to 20% by mass. As a result, aqueous dispersion (A1E) in which fine particles of amorphous polyester resin (A1) were dispersed was prepared. The dispersion diameter of amorphous polyester resin (A1) in aqueous dispersion (A1E) was 100 nm in terms of volume-based median diameter.

<Preparation of Dispersion (A2E) of Amorphous Polyester Resin (A2)>

Dispersion (A2E) was prepared using amorphous polyester resin (A2) by a similar method to the preparation of dispersion (A1E). The dispersion diameter of amorphous polyester resin (A2) in dispersion (A2E) was 100 nm in terms of volume-based median diameter.

<Preparation of Dispersion (C1E) of Crystalline Resin (C1)>

200 parts by mass of crystalline resin (C1) was dissolved in 200 parts by mass of ethyl acetate. While this solution was stirred, an aqueous solution obtained by dissolving sodium polyoxyethylene lauryl ether sulfate in 800 parts by mass of deionized water so as to have a concentration of 1% by mass was slowly added dropwise to the above solution. Next, ethyl acetate was removed from the obtained solution under reduced pressure, and then the pH was adjusted to 8.5 with ammonia. Thereafter, the solid content concentration was adjusted to 20% by mass. As a result, aqueous dispersion (C1E) in which fine particles of crystalline resin (C1) were dispersed was prepared. The dispersion diameter of crystalline resin (C1) in aqueous dispersion (C1E) was 250 nm in terms of volume-based median diameter.

<Preparation of Dispersions (C2E) and (C3E) of Crystalline Resins (C2) and (C3)>

Aqueous dispersions (C2E) and (C3E) were prepared using crystalline resins (C2) and (C3) by a similar method to the preparation of aqueous dispersion (C1E). The dispersion diameter of each of crystalline resins (C2) and (C3) in aqueous dispersions (C2E) and (C3E) was 250 nm in terms of volume-based median diameter.

<Preparation of Release Agent Particle Dispersion (W1)>

Hydrocarbon wax (paraffin wax, HNP-11 (manufactured by Nippon Seiro Co., Ltd., melting point 70° C.): 270 parts by mass Anionic surfactant (manufactured by Daiichi Kogyo Seiyaku Co., Ltd., Neogen RK, active ingredient amount 60% by mass): 13.5 parts by mass (3.0% by mass of active ingredient with respect to release agent)

Deionized water: 21.6 parts by mass

The above components were mixed, and paraffin wax as a release agent was dissolved therein with a pressure discharge type homogenizer (Gorin homogenizer manufactured by Gorin) at an internal liquid temperature of 120° C. Thereafter, dispersion treatment was performed at a dispersion pressure of 5 MPa for 120 minutes, and then at 40 MPa for 360 minutes, followed by cooling to obtain release agent dispersion (W1). The volume-based median diameter of the particles in the release agent dispersion (W1) was 225 nm. Thereafter, deionized water was added thereto to adjust the solid content concentration to 20.0% by mass.

<Preparation of Colorant Particle Dispersion (P1)>

A solution was manufactured by adding 90 parts by mass of sodium lauryl sulfate to 1600 parts by mass of deionized water. Then, while this solution was stirred, 220 parts by mass of C.I. Pigment Yellow 74 which is a pigment as a colorant was added thereto, and dispersed using a stirrer CLEARMIX (manufactured by M Technique Co., Ltd.) to prepare colorant particle dispersion (P1). The solid content of the colorant particles contained in this dispersion (P1) was 13.0%, and the volume-based median diameter thereof was 160 nm.

Note that the content of o-acetoacetaniside in C.I. Pigment Yellow 74 was measured and found to be 1050 ppm by mass.

<Preparation of Colorant Particle Dispersion (P2)>

As a pretreatment, C.I. Pigment yellow 74 (the content of o-acetoacetaniside in C.I. Pigment yellow 74 was 1050 ppm by mass) was repeatedly washed with ethanol and dried to prepare C.I. Pigment Yellow 74 in which the content of o-acetoacetaniside had been reduced to 1.2 ppm by mass.

A solution was manufactured by adding 90 parts by mass of sodium lauryl sulfate to 1600 parts by mass of deionized water. Then, while this solution was stirred, 220 parts by mass of the pretreated C.I. Pigment Yellow 74 (the content of o-acetoacetaniside in C.I. Pigment Yellow 74 was 1.2 ppm by mass) was added thereto, and dispersed using a stirrer CLEARMIX (manufactured by M Technique Co., Ltd.) to prepare colorant particle dispersion (P2). The solid content of the colorant particles contained in this dispersion (P2) was 13.0%, and the volume-based median diameter thereof was 160 nm.

<Preparation of Colorant Particle Dispersion (P3)>

A solution was manufactured by adding 90 parts by mass of sodium lauryl sulfate to 1600 parts by mass of deionized water. Then, while this solution was stirred, 220 parts by mass of C.I. Pigment Yellow 74 which is a pigment (the content of o-acetoacetaniside in C.I. Pigment Yellow 74 was 1050 ppm by mass) as a colorant and 0.22 g of o-acetoacetaniside were added thereto, and dispersed using a stirrer CLEARMIX (manufactured by M Technique Co., Ltd.) to prepare colorant particle dispersion (P3). The solid content of the colorant particles contained in this dispersion (P3) was 13.0%, and the volume-based median diameter thereof was 160 nm.

<Preparation of Colorant Particle Dispersion (P4)>

A solution was manufactured by adding 90 parts by mass of sodium lauryl sulfate to 1600 parts by mass of deionized water. Then, while this solution was stirred, 220 parts by mass of C.I. Pigment Red 122 which is a pigment as a colorant and 0.22 g of o-acetoacetaniside were added thereto, and dispersed using a stirrer CLEARMIX (manufactured by M Technique Co., Ltd.) to prepare colorant particle dispersion (P4). The solid content of the colorant particles contained in this dispersion (P4) was 13.0%, and the volume-based median diameter thereof was 160 nm.

<Preparation of Colorant Particle Dispersion (P5)>

A solution was manufactured by adding 90 parts by mass of sodium lauryl sulfate to 1600 parts by mass of deionized water. Then, while this solution was stirred, 220 parts by mass of C.I. Pigment Yellow 74 which is a pigment (the content of o-acetoacetaniside in C.I. Pigment Yellow 74 was 1050 ppm by mass) as a colorant and 3.2 parts by mass of o-acetoacetaniside were added thereto, and dispersed using a stirrer CLEARMIX (manufactured by M Technique Co., Ltd.) to prepare colorant particle dispersion (P5). The solid content of the colorant particles contained in this dispersion (P5) was 13.0%, and the volume-based median diameter thereof was 160 nm.

<Preparation of Colorant Particle Dispersion (P6)>

As a pretreatment, C.I. Pigment yellow 74 (the content of o-acetoacetaniside in C.I. Pigment yellow 74 was 1050 ppm by mass) was repeatedly washed with ethanol and dried to prepare C.I. Pigment Yellow 74 in which the content of o-acetoacetaniside had been reduced to 500 ppm by mass.

A solution was manufactured by adding 90 parts by mass of sodium lauryl sulfate to 1600 parts by mass of deionized water. Then, while this solution was stirred, 220 parts by mass of the pretreated C.I. Pigment Yellow 74 (the content of o-acetoacetaniside in C.I. Pigment Yellow 74 was 500 ppm by mass) was added thereto, and dispersed using a stirrer CLEARMIX (manufactured by M Technique Co., Ltd.) to prepare colorant particle dispersion (P6). The solid content of the colorant particles contained in this dispersion (P6) was 13.0%, and the volume-based median diameter thereof was 160 nm.

<Preparation of Colorant Particle Dispersion (P7)>

As a pretreatment, C.I. Pigment yellow 74 (the content of o-acetoacetaniside was 1050 ppm by mass) was repeatedly washed with ethanol and dried to prepare C.I. Pigment Yellow 74 in which the content of o-acetoacetaniside had been reduced to 0.8 ppm by mass.

A solution was manufactured by adding 90 parts by mass of sodium lauryl sulfate to 1600 parts by mass of deionized water. Then, while this solution was stirred, 220 parts by mass of the pretreated C.I. Pigment Yellow 74 (the content of o-acetoacetaniside in C.I. Pigment Yellow 74 was 0.8 ppm by mass) was added thereto, and dispersed using a stirrer CLEARMIX (manufactured by M Technique Co., Ltd.) to prepare colorant particle dispersion (P7). The solid content of the colorant particles contained in this dispersion (P7) was 13.0%, and the volume-based median diameter thereof was 160 nm.

<Preparation of Colorant Particle Dispersion (P8)>

A solution was manufactured by adding 90 parts by mass of sodium lauryl sulfate to 1600 parts by mass of deionized water. Then, while this solution was stirred, 220 parts by mass of C.I. Pigment Yellow 74 which is a pigment (the content of o-acetoacetaniside in C.I. Pigment Yellow 74 was 1050 ppm by mass) as a colorant and 0.26 g of o-acetoacetaniside were added thereto, and dispersed using a stirrer CLEARMIX (manufactured by M Technique Co., Ltd.) to prepare colorant particle dispersion (P8). The solid content of the colorant particles contained in this dispersion (P8) was 13.0%, and the volume-based median diameter thereof was 160 nm.

<Manufacture of Toner Particles (1)>

Into a reaction vessel equipped with a stirrer, a temperature sensor, and a cooling tube, 100 parts by mass (in terms of solid content) of amorphous polyester resin particle dispersion (A1E), 80 parts by mass (in terms of solid content) of amorphous polyester resin particle dispersion (A2E), 20 parts by mass (in terms of solid content) of release agent dispersion (W1), and 2000 parts by mass of deionized water were put. Thereafter, while the resulting solution was stirred at 20° C., a 5 mol/L sodium hydroxide aqueous solution was added thereto to adjust the pH of the solution to 10.

Furthermore, 20.0 parts by mass (in terms of solid content) of colorant particle dispersion (P1) was added thereto. An aqueous solution obtained by dissolving 60 parts by mass of magnesium chloride in 60 parts by mass of deionized water was added thereto under stirring at 30° C. over 10 minutes. The resulting solution was allowed to stand for three minutes, add 20 parts by mass (in terms of solid content) of aqueous dispersion (C1E) of crystalline polyester resin fine particles was added thereto over 10 minutes. Thereafter, the temperature was raised to 82° C. over 60 minutes, and a particle growth reaction was continued while the temperature was maintained at 82° C. In this state, the particle diameter of a particle was measured with "Multisizer 3" (manufactured by Beckman Coulter, Inc.). When the volume-based median diameter reached 6.0 μm, a sodium chloride aqueous solution obtained by dissolving 190 parts by mass of sodium chloride in 760 parts by mass of deionized water was added thereto to stop the particle growth.

Next, by heating and stirring the solution at 74° C., fusion of the particles was caused to proceed. When the average circularity of the particles (HPF detection number was 4000) measured using a measuring device FPIA-2100 (manufactured by Sysmex Corporation) reached 0.957, the solution was cooled to 30° C. at a cooling rate of 2.5° C./min.

Next, operation of performing solid-liquid separation, re-dispersing the dehydrated toner cake in deionized water, and performing solid-liquid separation was repeated three times. The toner cake was washed and then dried at 40° C. for 24 hours to obtain toner base particles.

Next, to 100 parts by mass of the obtained toner base particles, 0.6 parts by mass of hydrophobic silica (number average primary particle diameter 12 nm, hydrophobicity 68) and 1.0 part by mass of hydrophobic titanium oxide (number average primary particle diameter 20 nm, hydrophobicity 63) were added and mixed at 32° C. for 20 minutes at a rotating blade peripheral speed of 35 mm/sec using a Henschel mixer (manufactured by Nippon Coke & Engineering Co., Ltd.). Thereafter, the mixture was subjected to an external additive treatment for removing coarse particles using a sieve having an opening of 45 μm to obtain toner particles (1).

<Manufacture of Toner Particles (2) to (11)>

Toner particles (2) to (11) were manufactured by a manufacturing method similar to that for the above toner particles (1) except that the combination of dispersions (A1E) and (A2E) of amorphous polyester resin (A1), dispersions (C1E) to (C3E) of crystalline resin (C1), release agent particle dispersion (W1), and colorant particle dispersions (P1) to (P8) used for manufacturing toner particles was changed as illustrated in Table 1.

<Manufacture of Electrostatic Image Developing Developers (1) to (12)>

Into a high-speed mixer equipped with a stirring blade, 100 parts by mass of ferrite core and 5 parts by mass of cyclohexyl methacrylate/methyl methacrylate (copolymerization ratio 1:1) copolymer resin particles were put and stirred and mixed at 120° C. for 30 minutes to form a resin coat layer on a surface of the ferrite core by an action of mechanical impact force, thus obtaining carrier particles having a volume-based median diameter of 35 μm. The volume based median diameter of the carrier particles was measured with a laser diffraction particle size distribution measuring device (HELOS) (manufactured by SYMPATEC Gmbh) equipped with a wet type dispersing machine.

To the carrier particles, the above-described toner particles (1) to (11) were added such that the toner concentration was 6% by mass, and the resulting mixture was introduced into a micro type V-type mixer (Tsuji Chemical Co., Ltd.) and mixed for 30 minutes at a rotational speed of 45 rpm to manufacture developers (1) to (11), respectively.

Table 1 below illustrates combinations of materials in the toner particles (1) to (11) and developers (1) to (11). Note that C.I. Pigment Yellow is described as "CY", and C.I. Pigment Red is described as "PR" in Table 1.

TABLE 1

| | | Crystalline resin | | | | |
|---|---|---|---|---|---|---|
| Developer | Toner particles | Type of resin | Melting point (° C.) | Amorphous resin | Colorant dispersion | Colorant |
| 1 | 1 | C1 | 62 | A1/A2 | P1 | PY74 |
| 2 | 2 | C1 | 62 | A1/A2 | P2 | PY74 |
| 3 | 3 | C1 | 62 | A1/A2 | P3 | PY74 |
| 4 | 4 | C1 | 62 | A1/A2 | P4 | PR122 |
| 5 | 5 | C2 | 70 | A1/A2 | P1 | PY74 |
| 6 | 6 | C3 | 57 | A1/A2 | P1 | PY74 |
| 7 | 7 | C1 | 62 | A1/A2 | P5 | PY74 |
| 8 | 8 | C1 | 62 | A1/A2 | P6 | PY74 |
| 9 | 9 | C1 | 62 | A1/A2 | P7 | PY74 |
| 10 | 10 | C1 | 62 | A1/A2 | P8 | PY74 |
| 11 | 11 | — | — | A1/A2 | P1 | PY74 |

<Evaluation>

Toner particles (1) to (11) and developers (1) to (11) thus manufactured were evaluated as follows. Note that for image output, an evaluation device modified such that a surface temperature of a fixing heat roller of bizhub PRESS C1100 (manufactured by Konica Minolta Co., Ltd.) could be changed within a range of 80 to 140° C. was used. In this evaluation device, each of the toner particles and each of the developers prepared as described above were filled in a toner cartridge and a developing machine, respectively, to obtain an image forming apparatus for evaluation.

[Evaluation of Low-Temperature Fixability]

Low-temperature fixability of a toner was evaluated using A4 size OK top coat+(127.9 g/m$^2$) (manufactured by Oji Paper Co., Ltd.) in normal temperature and normal humidity environment (temperature 20° C., humidity 50% RH; NN environment). A fixing test to fix a solid image with a toner adhesion amount of 11 g/m$^2$ was repeated until the temperature reached 140° C. while the temperature of a lower fixing roller was set to a temperature 20° C. lower than the temperature of an upper fixing belt, and a surface temperature of the upper fixing belt was increased from 80° C. in units of 5° C.

Next, the printed matter obtained in the above test was folded with a folding machine so as to apply a load to the solid image, and 0.35 MPa compressed air was blown on to the printed matter. A fold was ranked in five stages illustrated in the following evaluation criteria.

Rank 5: No fold

Rank 4: Peeling is partially observed according to a fold

Rank 3: Fine linear peeling is observed along a fold

Rank 2: Thick linear peeling is observed along a fold

Rank 1: Large peeling is observed

Evaluation was performed using the fixing temperature in the fixing test with the lowest fixing temperature as a lower limit fixing temperature of each toner among the fixing tests with a rank of 3 or higher in the above evaluation criteria. The lower the lower limit fixing temperature was, the better the low-temperature fixability was. A sample having the lower limit fixing temperature of 120° C. or lower had no practical problem, and was judged to be acceptable.

[Evaluation of Image Density]

A test chart for reflection density measurement was created under the same conditions as the low-temperature fixability evaluation test. The test chart was created such that the toner adhesion amount on a sheet was 3.5 g. The fixing temperature was set to +10° C. of the lower limit fixing temperature determined in the low-temperature fixability evaluation test.

The neutral reflection density of the obtained test chart was measured with a PDA-65 densitometer (manufactured by Konica Minolta Inc.). As the measured density was higher, it was evaluated that coloring power was better. A case where the reflection density was 1.0 or more was judged to be acceptable.

A: more than 1.20

B: 1.10 to 1.20

C: 1.00 to 1.10

D: less than 1.00

[Evaluation of Heat-Resistant Storage Stability]

Into a 10 mL, glass bottle with an inner diameter of 21 mm, 0.5 g of toner particles were put. A lid was closed, and the toner particles were shaken 600 times at room temperature with Tap Denser KYT-2000 (manufactured by Seishin Enterprise Co., Ltd.). Thereafter, the glass bottle was allowed to stand in an environment of 55° C. and 35% RH for two hours with the lid of the glass bottle removed.

Next, the toner particles after being allowed to stand were placed on a 48 mesh (aperture 350 μm) sieve while attention was paid not to disintegrate the aggregates of the toner particles. The sieve was set in a powder tester (manufactured by Hosokawa Micron Corporation), and fixed with a holding bar and a knob nut. Then, vibration strength was adjusted to a feed width of 1 mm. Vibration was applied for 10 seconds, and then the ratio of the amount of toner particles remaining on the sieve (toner aggregation ratio At, % by mass) was measured. At was calculated by the following formula.

$$At\ (\%\ by\ mass) = (mass\ of\ residual\ toner\ particles\ on\ sieve\ (g))/0.5\ (g) \times 100$$

From the determined At, heat-resistant storage stability of toner particles was evaluated according to the following criteria. Toner particles having an evaluation result of A, B, or C had no practical problem, and were judged to be acceptable.

A: Toner aggregation ratio is less than 15% by mass (toner particles have very good heat-resistant storage stability)

B: Toner aggregation ratio is more than 15% by mass and less than 20% by mass (toner particles have good heat-resistant storage stability)

C: Toner aggregation ratio is 20% by mass or more and less than 25% by mass (toner particles have slightly poor heat-resistant storage stability)

D: Toner aggregation ratio is 25% by mass or more (toner particles have poor heat-resistant storage stability and cannot be used)

Table 2 below illustrates the contents of o-acetoacetaniside and evaluation results of the toner particles (1) to (11) and the developers (1) to (11). Note that o-acetoacetaniside is described as "AAOA" in Table 2.

resin, a crystalline resin, and 0.1 ppm by mass or more and 200 ppm by mass or less of o-acetoacetaniside in toner base particles have good low-temperature fixability and high image density. In addition, the toners have good heat-resistant storage stability.

Toner particles (9) in which the content of o-acetoacetaniside in the toner base particles is 0.08 ppm by mass have higher fixing temperature and poorer evaluation for heat-resistant storage stability than toner particles (2) in which the content of o-acetoacetaniside in the toner base particles is 0.1 ppm by mass Therefore, when the toner base particles contain 0.1 ppm by mass or more of o-acetoacetaniside, constant temperature fixability, image density, and heat resistance of toner particles and a developer are improved.

Toner particles (10) in which the content of o-acetoacetaniside in the toner base particles is 210 ppm by mass have higher fixing temperature and poorer evaluation for heat-resistant storage stability than toner particles (3) in which the content of o-acetoacetaniside in the toner base particles is 200 ppm by mass. Therefore, when the toner base particles contain 200 ppm by mass or less of o-acetoacetaniside, constant temperature fixability, image density, and heat resistance of toner particles and a developer are improved.

Toner particles (4) contain 100 ppm by mass of o-acetoacetaniside in the toner base particles, and contain C.I. Pigment Red 122 as a colorant. In contrast, toner particles (1), (5), and (6) each contain the same amount of o-acetoacetaniside content (100 ppm by mass), and each contain 10.0% by mass of C.I. Pigment Yellow 74 as a colorant.

Toner particles (4) have 100° C. as an evaluation result of low-temperature fixability, whereas toner particles (1) have 93° C., toner particles (5) have 95° C., and toner particles (6) have 90° C. From this result, when the toner particles contain C.I. Pigment Yellow 74 as a colorant, low-temperature fixability of the toner particles is easily improved.

Toner particles (7) contain 100 ppm by mass of o-acetoacetaniside in the toner base particles, but contain C.I. Pigment Yellow 74 in such a small amount of 0.7% by mass. The developer using toner particles (7) has lower evaluation for image density and lower evaluation for heat-resistant storage stability than the developer using toner particles (1) containing 10.0% by mass of C.I. Pigment Yellow 74.

Toner particles (8) contain 100 ppm by mass of o-acetoacetaniside in the toner base particles, but contain C.I. Pigment Yellow 74 in such a large amount of 20.3% by mass. Toner particles (8) have higher fixing temperature than toner particles (1).

TABLE 2

| Developer | Toner particles | AAOA content of colorant (ppm by mass) | Amount of AAOA added to colorant (ppm by mass) | Colorant (% by mass) | AAOA content of toner base particles (ppm by mass) | Evaluation result: low-temperature fixability | Image density | Heat resistance |
|---|---|---|---|---|---|---|---|---|
| 1 | 1 | 1050 | 0.0 | 10.0 | 100 | 93 | A | A |
| 2 | 2 | 1.2 | 0.0 | 10.0 | 0.1 | 119 | B | B |
| 3 | 3 | 1050 | 1000.0 | 10.0 | 200 | 112 | B | B |
| 4 | 4 | 0 | 1000.0 | 10.0 | 100 | 100 | A | A |
| 5 | 5 | 1050 | 0.0 | 10.0 | 100 | 95 | B | B |
| 6 | 6 | 1050 | 0.0 | 10.0 | 100 | 90 | A | A |
| 7 | 7 | 1050 | 14500.0 | 0.7 | 100 | 96 | C | C |
| 8 | 8 | 505 | 0.0 | 20.3 | 100 | 118 | A | A |
| 9 | 9 | 0.8 | 0.0 | 10.0 | 0.08 | 128 | B | D |
| 10 | 10 | 1050 | 1180.0 | 10.0 | 210 | 124 | B | D |
| 11 | 11 | 1050 | 0.0 | 10.0 | 100 | 135 | D | A |

As illustrated in Table 2, developers (1) to (8) using toner particles (1) to (8) each containing an amorphous polyester Therefore, even if the content of o-acetoacetaniside in the toner base particles is the same, when the amount of a colorant is excessive or insufficient, evaluation for low-temperature fixability, image density, and heat-resistant storage stability is easily deteriorated.

Although embodiments of the present invention have been described and illustrated in detail, the disclosed embodiments are made for purposes of illustration and example only and not limitation. The scope of the present invention should be interpreted by terms of the appended claims, and various modifications and changes can be made without departing from the configuration of the present invention.

What is claimed is:

1. An electrostatic image developing toner comprising toner base particles, wherein the toner base particles contain;

an amorphous polyester resin;

a crystalline resin; and o-acetoacetaniside, and the content of the o-acetoacetaniside in the toner base particles is 0.1 ppm by mass or more and 200 ppm by mass or less.

2. The electrostatic image developing toner according to claim 1, wherein the content of the o-acetoacetaniside is 0.1 ppm by mass or more and 150 ppm by mass or less.

3. The electrostatic image developing toner according to claim 1, wherein the content of the o-acetoacetaniside is 0.1 ppm by mass or more and 100 ppm by mass or less.

4. The electrostatic image developing toner according to claim 1, comprising a crystalline polyester resin as the crystalline resin.

5. The electrostatic image developing toner according to claim 1, comprising the crystalline resin having a lower melting point than the o-acetoacetaniside.

6. The electrostatic image developing toner according to claim 1, comprising a colorant, wherein the content of the colorant in the electrostatic image developing toner is 1% by mass or more and 20% by mass or less.

7. The electrostatic image developing toner according to claim 6, comprising C.I. Pigment Yellow 74 as the colorant.

8. A developer comprising: an electrostatic image developing toner containing toner base particles; and carrier particles, wherein the toner base particles contain;

an amorphous polyester resin;

a crystalline resin; and o-acetoacetaniside, and the content of the o-acetoacetaniside in the toner base particles is 0.1 ppm by mass or more and 200 ppm by mass or less.

* * * * *